US012628891B2

(12) United States Patent
Adams et al.

(10) Patent No.: US 12,628,891 B2
(45) Date of Patent: May 19, 2026

(54) COATED GLOVE AND FIXTURE FOR FORMING COATED GLOVE

(71) Applicant: Milwaukee Electric Tool Corporation, Brookfield, WI (US)

(72) Inventors: Caleb C. Adams, Milwaukee, WI (US); Andrew N. Hoyle, Milwaukee, WI (US); Timothy W. Shay, Milwaukee, WI (US); Matthew W. Roeber, Milwaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 18/912,743

(22) Filed: Oct. 11, 2024

(65) Prior Publication Data

US 2025/0160456 A1 May 22, 2025

Related U.S. Application Data

(60) Provisional application No. 63/622,866, filed on Jan. 19, 2024, provisional application No. 63/617,538,
(Continued)

(51) Int. Cl.
*A41D 19/04* (2006.01)
*A41D 19/015* (2006.01)

(52) U.S. Cl.
CPC ..... *A41D 19/04* (2013.01); *A41D 19/015* (2013.01); *A41D 2600/20* (2013.01)

(58) Field of Classification Search
CPC .... A41D 19/04; A41D 19/043; A41D 19/046; A41D 19/02; A41D 19/05;
(Continued)

(56) References Cited

U.S. PATENT DOCUMENTS 726,666 A * 4/1903 Foulds ..... D06F 59/04 223/78
760,102 A * 5/1904 Carnes ..... A61F 2/588 623/61

(Continued)

FOREIGN PATENT DOCUMENTS

CN 108634454 10/2018
CN 110884011 3/2020

(Continued)

OTHER PUBLICATIONS

Anti-Vibration Cut Level 4 High Dexterity Nitrile Dipped Gloves, <https://www.milwaukeetool.com/Products/Work-Gear/Gloves/Anti-Vibration-Cut-Level-4-High-Dexterity-Nitrile-Dipped-Gloves>, believed to be commercially available at least by Sep. 25, 2024, Retrieved on Sep. 25, 2024, 3 pages.

(Continued)

*Primary Examiner* — F Griffin Hall
(74) *Attorney, Agent, or Firm* — Reinhart Boerner Van Deuren s.c.

(57) ABSTRACT

A fixture for forming a coated glove is provided. The fixture includes a mandrel configured to move between a dipping position and a curing position, a plurality of finger supports, and a thumb support. The mandrel includes a body with a top surface and a bottom surface. Each finger support of the plurality of finger supports includes a first surface facing away from the top surface. When the mandrel is in the dipping position, a portion of the bottom surface of the body and each first surface of the plurality of finger supports are coplanar. When the mandrel is moved from the dipping position to the curing position, the finger supports pivot with respect to the mandrel in a direction towards the bottom surface of the body.

18 Claims, 5 Drawing Sheets

Related U.S. Application Data filed on Jan. 4, 2024, provisional application No. 63/601,996, filed on Nov. 22, 2023.

(58) Field of Classification Search
CPC ... A41D 2600/20; A47F 8/00; B29D 99/0067; B29L 2031/4864; A61F 2/583; A61F 2/586
See application file for complete search history.

(56) References Cited

U.S. PATENT DOCUMENTS

| | | | | |
|---|---|---|---|---|
| 818,178 | A * | 4/1906 | Lane | D06F 59/04 223/78 |
| 1,102,224 | A * | 6/1914 | Carron | D06F 59/04 223/79 |
| 2,134,974 | A * | 11/1938 | Hurwitz | A63H 3/04 223/78 |
| 2,716,241 | A | 8/1955 | Goodman | |
| 2,907,047 | A | 10/1959 | Steinberg | |
| 3,004,516 | A | 10/1961 | Marsden et al. | |
| 3,079,274 | A | 2/1963 | Marsden et al. | |
| 3,159,504 | A * | 12/1964 | Sarjanian | B29C 41/40 223/78 |
| 3,377,627 | A * | 4/1968 | Madnick | A41D 19/01 2/169 |
| 3,486,670 | A * | 12/1969 | Sutton | D06F 59/04 223/78 |
| 3,613,172 | A | 10/1971 | Giambrone | |
| 3,707,005 | A | 12/1972 | Giambrone | |
| 4,018,382 | A * | 4/1977 | DiCuya | A41D 19/04 223/78 |
| 4,189,787 | A | 2/1980 | Stansbury | |
| 4,218,778 | A | 8/1980 | Stansbury | |
| 4,472,836 | A * | 9/1984 | Shikatani | D06F 59/04 223/79 |
| 5,246,658 | A | 9/1993 | Tanaka | |
| 5,581,812 | A | 12/1996 | Krocheski | |
| 5,907,870 | A | 6/1999 | Monroe et al. | |
| 7,281,645 | B2 * | 10/2007 | Cho | A41D 19/04 223/78 |
| D645,212 | S | 9/2011 | Gellis | |
| D647,278 | S | 10/2011 | Gellis | |
| D648,919 | S | 11/2011 | Gellis | |
| D650,968 | S | 12/2011 | Gellis | |
| 9,179,718 | B2 | 11/2015 | Anstey | |
| 9,346,202 | B2 | 5/2016 | Gellis | |
| 9,498,009 | B2 | 11/2016 | Gellis | |
| 9,555,567 | B2 | 1/2017 | Gellis | |
| 9,801,422 | B2 | 10/2017 | Anstey | |
| 10,113,264 | B2 | 10/2018 | Hollis | |
| 10,271,597 | B2 | 4/2019 | Gellis | |
| 10,362,818 | B2 | 7/2019 | Gellis | |
| 10,420,382 | B2 | 9/2019 | Gellis | |
| 10,548,359 | B2 | 2/2020 | Anstey | |
| 10,993,489 | B2 | 5/2021 | Hoppe et al. | |
| 2006/0143767 | A1 | 7/2006 | Yang et al. | |
| 2006/0150299 | A1 * | 7/2006 | Geng | A41D 19/0006 2/161.6 |
| 2014/0150162 | A1 | 6/2014 | Guan | |
| 2016/0263852 | A1 * | 9/2016 | Myers | B29C 41/40 |
| 2019/0387820 | A1 | 12/2019 | Gellis | |
| 2020/0138131 | A1 | 5/2020 | Anstey | |
| 2020/0375285 | A1 | 12/2020 | Anstey | |
| 2021/0030086 | A1 | 2/2021 | Wong et al. | |
| 2021/0219641 | A1 | 7/2021 | Hoppe et al. | |

FOREIGN PATENT DOCUMENTS

| | | |
|---|---|---|
| CN | 211323179 | 8/2020 |
| CN | 111745876 | 10/2020 |
| DE | 651174 | 10/1937 |

OTHER PUBLICATIONS

Cut Level 1 Nitrile Dipped Gloves, <https://www.milwaukeetool.com/Products/Safety-Solutions/Personal-Protective-Equipment/Gloves/Cut-Level-1-Nitrile-Dipped-Gloves>, believed to be commercially available at least by Apr. 1, 2023, Retrieved on Sep. 25, 2024, 6 pages.

Cut Level 4 High-Dexterity Nitrile Dipped Gloves, <https://www.milwaukeetool.com/Products/Safety-Solutions/Personal-Protective-Equipment/Gloves/Cut-Level-4-High-Dexterity-Nitrile-Dipped-Gloves>, believed to be commercially available at least by Sep. 25, 2024, Retrieved on Sep. 25, 2024, 4 pages.

Cut Level 9 High-Dexterity Nitrile Dipped Gloves, <https://www.milwaukeetool.com/Products/Safety-Solutions/Personal-Protective-Equipment/Gloves/Cut-Level-9-High-Dexterity-Nitrile-Dipped-Gloves>, believed to be commercially available at least by Mar. 24, 2023, Retrieved on Sep. 25, 2024, 4 pages.

Cut Level 4 Winter Dipped Gloves, <https://www.milwaukeetool.com/Products/Safety-Solutions/Personal-Protective-Equipment/Gloves/Cut-Level-4-Winter-Dipped-Gloves>, believed to be commercially available at least by Sep. 25, 2024, Retrieved on Sep. 25, 2024, 4 pages.

* cited by examiner

COATED GLOVE AND FIXTURE FOR FORMING COATED GLOVE

CROSS-REFERENCE TO RELATED PATENT APPLICATIONS

The present application claims the benefit of and priority to U.S. Provisional Application No. 63/622,866, filed on Jan. 19, 2024, U.S. Provisional Application No. 63/617,538, filed Jan. 4, 2024, and U.S. Provisional Application No. 63/601,996, filed Nov. 22, 2023, which are incorporated herein by reference in their entireties.

BACKGROUND OF THE INVENTION

The present invention relates generally to the field of gloves. The present invention relates specifically to a glove, such as a work glove, with a coating layer and a fixture including a movable mandrel for forming such a glove.

SUMMARY OF THE INVENTION

One embodiment of the invention relates to a fixture for forming a coated glove. The fixture comprises a mandrel, a plurality of finger supports, and a thumb support. The mandrel is configured to move between a first position and a second position. The mandrel includes a first end, a second end opposite the first end, and a body extending between the first end and the second end. The body includes a top surface and a bottom surface opposite the top surface. The plurality of finger supports is coupled to the second end of the mandrel. Each finger support in the plurality of finger supports includes a first surface facing away from the top surface of the body. The thumb support is coupled to the body. When the mandrel is in the first position, a portion of the bottom surface of the body located adjacent to the second end of the mandrel and each first surface of the plurality of finger supports are coplanar. When the mandrel is moved from the first position to the second position, the plurality of finger supports pivots with respect to the mandrel in a direction towards the bottom surface of the body.

Another embodiment of the invention relates to a fixture for forming a coated glove. The fixture includes a mandrel configured to move between a dipping position and a curing position. The mandrel includes a first end configured to be mounted on a machine during the forming of a coated glove and a second end opposite the first end. The mandrel further includes a thumb support coupled to the mandrel between the first end and the second end, a first finger support coupled to the second end of the mandrel, a second finger support coupled to the second end of the mandrel and positioned adjacent to the first finger support, and a third finger support coupled to the second end of the mandrel and positioned adjacent to the second finger support. When the mandrel is in the dipping position, a bottom surface of the first finger support, a bottom surface of the second finger support, and a bottom surface of the third finger support, each extend along substantially the same plane. When the mandrel is in the curing position, the bottom surface of the first finger support, the bottom surface of the second finger support, and the bottom surface of the third finger support, each are curved in a direction towards the first end of the mandrel.

Another embodiment of the invention relates to a method of forming a coated glove. The method includes placing the glove on a fixture including a mandrel with a first end and a second end, a plurality of finger supports coupled to the second end of the mandrel, and a thumb support coupled to the mandrel between the first end and the second end. The mandrel is configured to move between a first position and a second position. The method further includes moving the mandrel into the first position, dipping a portion of the glove into a coating material, moving the mandrel into the second position, and curing the coating material to form a coating layer along an outer surface of the glove. The coating layer is a single, contiguous, and continuous layer located along a palm portion, a thumb portion, a bottom side of an index finger portion, a bottom side of a middle finger portion, a bottom side of a ring finger portion, and a bottom side of a little finger portion of the glove.

Additional features and advantages will be set forth in the detailed description which follows and will be readily apparent to those skilled in the art from the description or recognized by practicing the embodiments as described in the written description and/or shown in the accompany drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments. In addition, alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1:
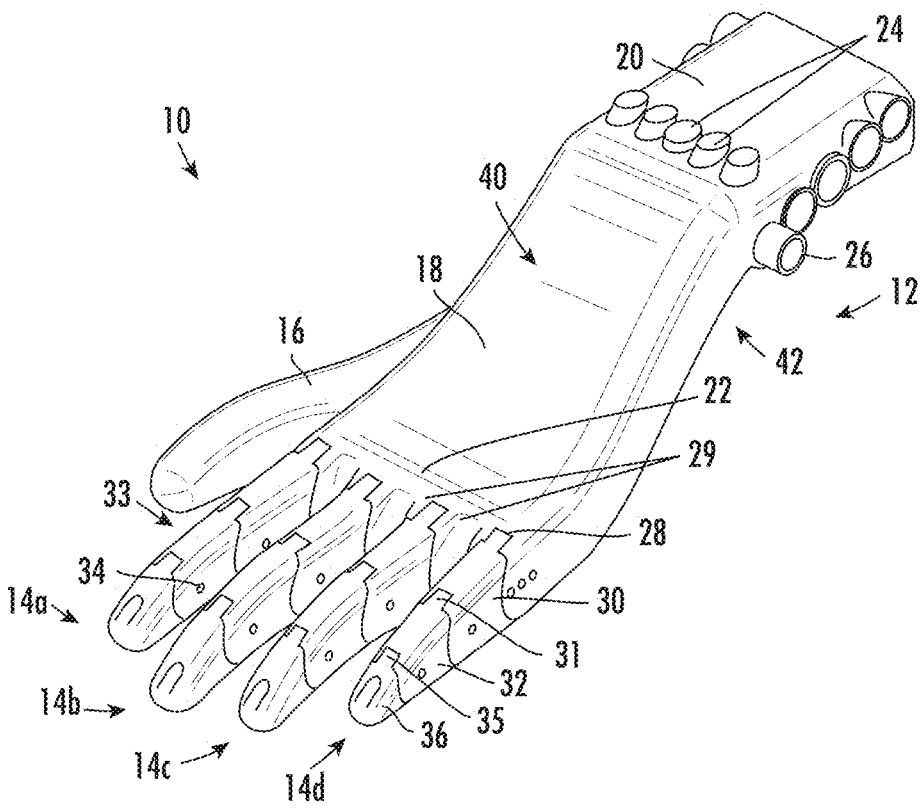
FIG. 1 is a front perspective view of a fixture with a mandrel in a first position, according to an exemplary embodiment.

Referring generally to the figures, various embodiments of a coated glove and a fixture for forming such a coated glove are shown. During manufacture of some coated gloves, gloves are dipped into a liquid material (e.g., a liquid polymer forming material) and then cured to create a coating layer (e.g., an external polymer coating layer) on the gloves. When the glove is cured, the coating layer solidifies and contributes to the shape of the finished glove. Some conventional fixtures for forming coated gloves include a mandrel that supports the glove during dipping and curing. Such mandrels are rigid and mimic a hand in a flattened shape (i.e., the fingers are oriented along a single plane). This shape is not anatomically correct in that it is unnaturally flat.

Applicant has identified that such shapes affect the fit and stretch of the coated glove because, typically, the coating layers cannot be adjusted or reformed after curing.

In some conventional methods for forming a coated glove, after gloves have been dipped and cured on a first (flattened shaped) mandrel, the gloves are manually transferred to a second mandrel where the glove can be reheated and reformed. Applicant has identified that reheating and reforming may be difficult to apply to gloves with certain coating materials, such as nitrile coatings and thermosetting polymers because these coating materials have a higher heat resistance.

In contrast, as discussed herein, Applicant has developed various coated gloves and fixtures for forming such coated gloves that are believed to provide for various advantages over conventional coated gloves and fixtures. Specifically, the fixtures described herein include a mandrel that is configured to actuate between a dipping position and a curing position. In the dipping position, the fixture allows the glove to be dipped such that dipping material is applied to the palm, palm-side of the fingers, and left and right sides of the fingers, but not to the back of the hand. In the curing position, the fixture allows the glove to be positioned in a configuration that more closely resembles the shape of a human hand (i.e., with the fingers articulated slightly towards the palm). Thus, when the coating material cures/solidifies with the fixture in the curing position, the glove assumes a finished or resting state that resembles the shape of a human hand at rest (i.e., with the finger portion of the glove curved slightly towards the palm).

Applicant believes that the fixtures discussed herein allow for a glove to be formed in a shape that more closely resembles the shape of a human hand without the need to manually transfer the glove between mandrels and/or without the need to reheat and reform the glove. Applicant believes that this may enable the process to be applied to coating materials, like nitrile and thermosetting polymers.

Further, Applicant believes that the positioning of the fixture provides a coated glove with improved fit and stretch because the cured coated glove will more closely mirror a natural hand position and may allow for less force needed by a user to close the hand when performing a task. Further, in some embodiments, Applicant believes that this curing positioning may improve coating layer thickness, consistency, and/or control, allowing for the formation of gloves with better, more consistently formed coating layers.

Figure 2:
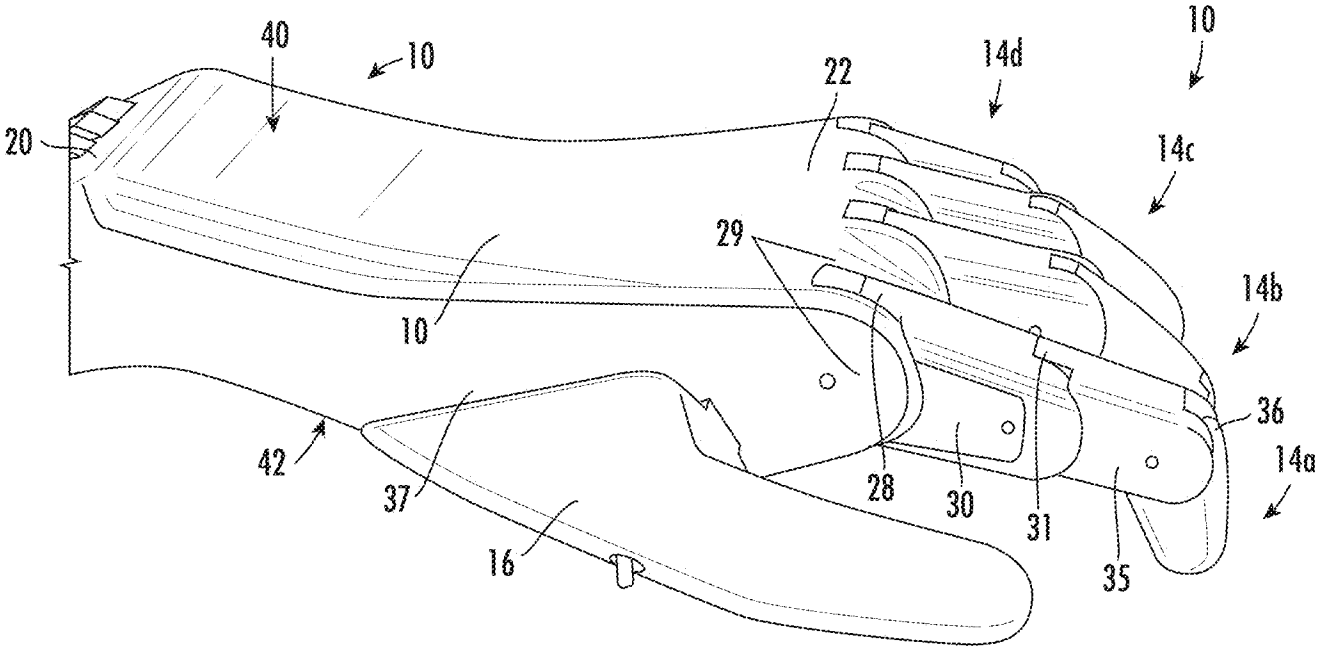
FIG. 2 is a side perspective view of the fixture of FIG. 1 with the mandrel in a second position, according to an exemplary embodiment.

Referring to FIGS. 1-2, a fixture 10 for forming a coated glove is shown, according to an exemplary embodiment. Fixture 10 includes a body, shown as articulated mandrel 12, and a plurality of appendages, shown as finger supports 14 and thumb support 16, coupled to mandrel 12. Mandrel 12, finger supports 14, and thumb support 16 are configured to support a glove during dipping and curing. Mandrel 12 is configured to move between a first position or dipping position and a second position or curing position. In various embodiments, fixture 10 may include one or more locking mechanisms for securing mandrel 12 in the first position and the second position.

Mandrel 12 includes a body or palm support 18 which extends between a first end portion 20 and a second end portion 22 located opposite first end portion 20. Palm support 18 is sloped between first end portion 20 and second end portion 22 such that first end portion 20 lies of a first plane and second end portion 22 lies on a second plane spaced from and substantially parallel with the first plane. First end portion 20 is configured to be held by a user and/or configured to be mounted to a machine during the forming process of a glove (e.g., during dipping and/or curing of the glove).

First end portion 20 includes a plurality of projections 24 extending from a top surface of first end portion 20. Additionally, first end portion 20 includes a side projection 26 extending from a side of first end portion 20.

The plurality of appendages is shown as finger supports 14 and thumb support 16. When mandrel 12 is moved between the dipping position and the curing position, finger supports 14 and thumb support 16 move with respect to mandrel 12. In this way, finger supports 14 and thumb support 16 are differently oriented in the dipping position than in the curing position.

Finger supports 14 are coupled to second end portion 22 and extend in a direction away from first end portion 20, palm support 18, and second end portion 22. Each finger support 14 is sized and shaped similar to the human finger, such that finger supports 14 can be received in the fingers of a glove. Specifically, finger supports 14 are tapered such that the thickest portion of each finger support 14 is coupled to second end portion 22 and the narrowest portion of each finger support 14 is located at an end of the finger support 14 furthest from the second end portion 22 of mandrel 12.

As shown, finger supports 14 include a first finger support 14*a*, which corresponds to the index finger of a hand, a second finger support 14*b*, which corresponds to the middle finger of a hand, third finger support 14*c*, which corresponds to the ring finger of a hand, and fourth finger support 14*d*, which corresponds to the little or pinkie finger of a hand.

Each finger support 14 includes a first section 30, a second section 32, and a third section 36. Further, each finger support 14 has a right side 34 and a left side 33 opposite right side 34. First section 30 is pivotally coupled to second end portion 22 by a joint 28. Joint 28 may be unitary with first section 30 such that first section 30 and joint 28 are made from a single, continuous, and contiguous piece of material. Joint 28 extends into second end portion 22 and is coupled between two projections 29.

First section 30 and second section 32 are pivotally coupled to each other by joint 31. Joint 31 may be unitary with second section 32 such that second section 32 and joint 31 are made from a single, continuous, and contiguous piece of material. Joint 31 extends at least part way into first section 30. Joint 31 is coupled between left side 33 and right side 34 of finger support 14 along first section 30.

Second section 32 and third section 36 are pivotally coupled to each other by joint 35. Joint 35 may be unitary with third section 36 such that third section 36 and joint 35 are made from a single, continuous, and contiguous piece of material. Joint 35 extends at least part way into second section 32. Joint 35 is coupled between left side 33 and right side 34 of finger support 14 along second section 32. In this way, joints 28, 31, and 35 allow for each finger support 14 to bend or curve with respect to mandrel 12.

Thumb support 16 is coupled to palm support 18 of mandrel 12 between first end portion 20 and second end portion 22. Thumb support 16 is coupled to palm support 18 approximately where a thumb is located on a palm of a hand. Thumb support 16 may be pivotally coupled to palm support 18 such that it can move between the dipping position and curing position. As shown, thumb support 16 includes a single joint 37. In specific embodiments, thumb support 16 may include two or more sections and joints (similar to finger supports 14).

As shown in FIG. 1, fixture 10 is shown with mandrel 12 in the first position or dipping position. In the dipping position, fixture 10 allows for a glove to be dipped in a coating material. In a specific embodiment, fixture 10 allows for the coating material to be applied to the glove along the palm, the bottom/palm-side of the fingers, and the left and right sides of the fingers, but not applied to the back of the glove opposite the palm.

When in the dipping position, a portion of palm support 18, finger supports 14, and thumb support 16 all extend along substantially the same plane. That is, when mandrel 12 is in the dipping position, a bottom surface of second end portion 22, a bottom surface of each of the finger supports 14, and a bottom surface of thumb support 16 are substantially coplanar with each other. This positioning resembles the flattening of a human hand against a surface. So, as shown, palm support 18 curves in a direction away from finger supports 14.

Specifically, each finger support 14 is flattened and sections 30, 32, and 36 pivot with respect to each other and second end portion 22. For each finger support 14, joints 28, 31, and 35 are aligned. In this way, an edge of joint 28 may abut an inner face of second end portion 22, an edge of joint 31 may abut an inner face of first section 30, and an edge of joint 35 may abut an inner face of second section 32. So, when in the dipping position, there is less space between first section 30 and second end portion 22, second section 32 and first section 30, and third section 36 and second section 32, than in the curing position. Thumb support 16 moves in a direction towards top surface 40 of mandrel and away from bottom surface 42 of mandrel.

As shown in FIG. 2, fixture 10 is shown with mandrel 12 in the second position or curing position. In the curing position, fixture 10 is configured such that a glove mounted on fixture 10 is positioned in a configuration that more closely resembles the shape of a human hand at rest (i.e., with the fingers articulated slightly towards the palm). So, when the coating layer on the glove is cured, the resulting glove has a curve similar to the curvature of a user's hand.

Specifically, finger supports 14 pivot with respect to mandrel 12 and curve in a direction towards bottom surface 42 of mandrel 12, with second finger support 14*b* and third finger support 14*c* curved slightly more than first finger support 14*a*. Thumb support 16 moves down with respect to palm support 18 towards bottom surface 42. So, at least a portion of thumb support 16 is extends past bottom surface 42.

Each finger support 14 curves towards bottom surface 42 such that sections 30, 32, and 36 pivot with respect to each other and second end portion 22. As shown, third section 36 pivots with respect to second section 32 such that a tip of finger supports 14 is facing away from top surface 40 and away from bottom surface 42. Third section 36 pivots with respect to second section 32 a greater amount than second section 32 pivots with respect to first section 30.

Each finger support 14 defines a first angle, a second angle, and a third angle. The first angle is defined between second end portion 22 and first section 30. The second angle is defined between first section 30 and second section 32. The third angle is defined between second section 32 and third section 36. In a specific embodiment, first angle is at least 170 degrees, when in the dipping position. In another specific embodiment, first angle is at most 135 degrees, when in the curing position.

Figure 3:
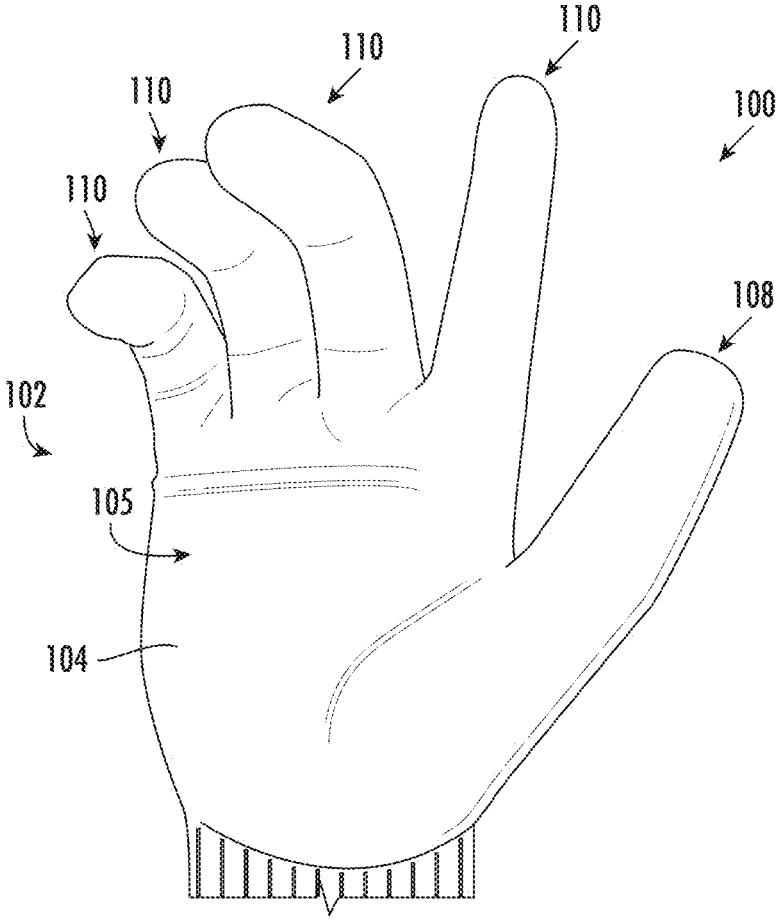
FIG. 3 is a bottom view of a coated glove, according to an exemplary embodiment.
Figure 4:
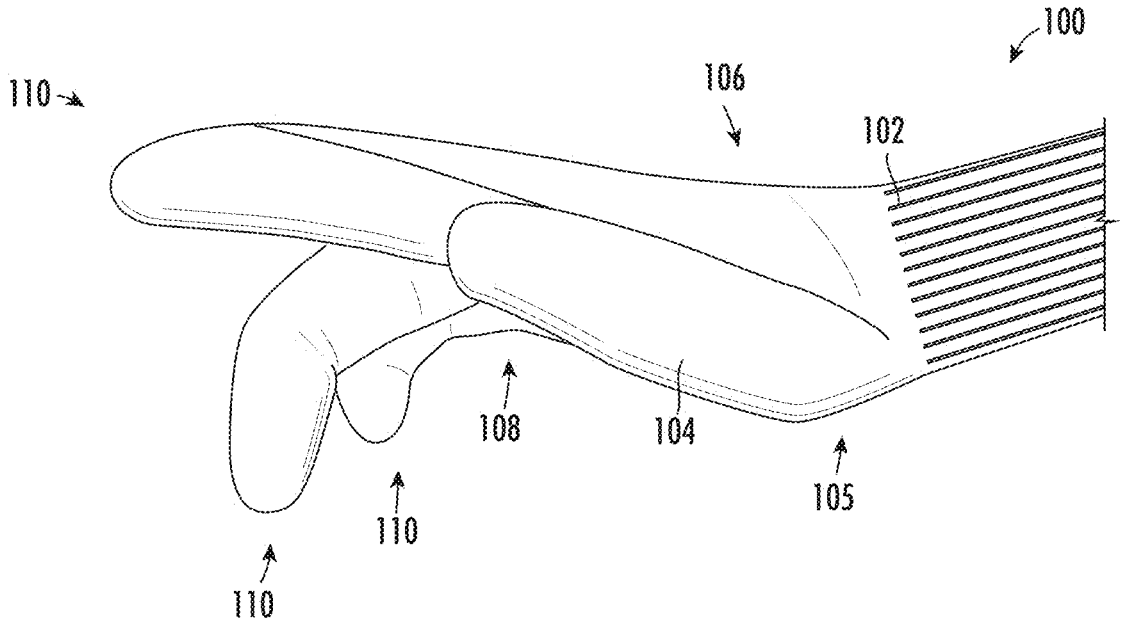
FIG. 4 is a left-side view of the coated glove of FIG. 3, according to an exemplary embodiment.
Figure 5:
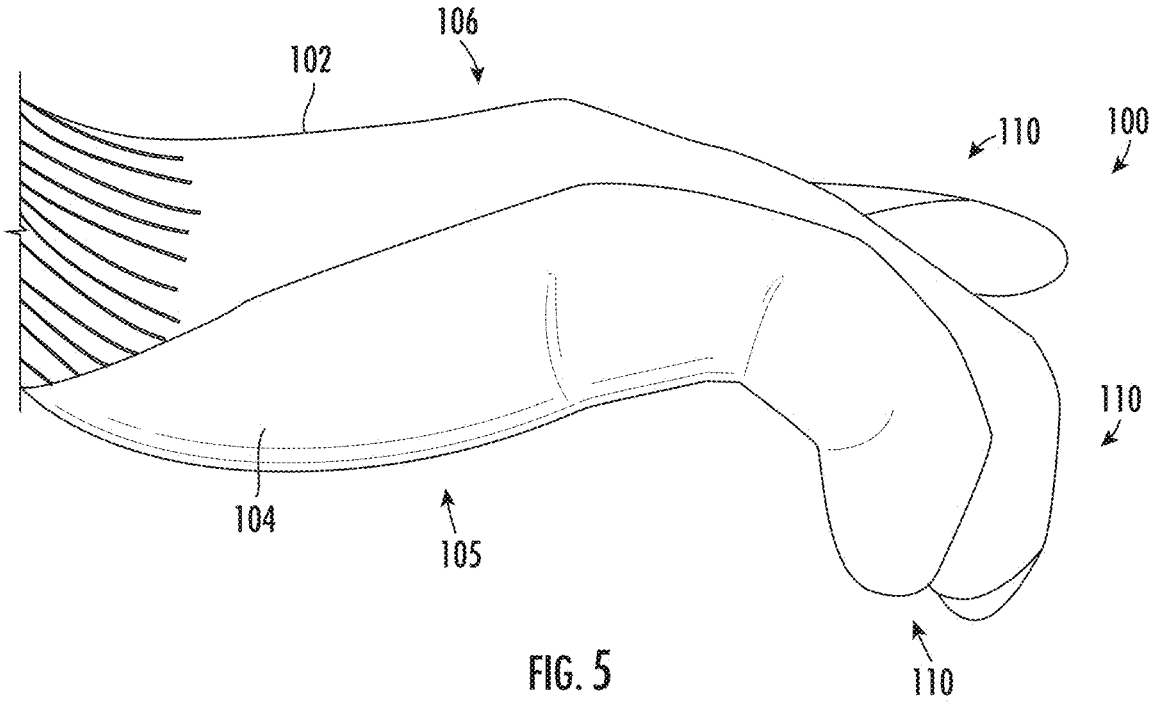
FIG. 5 is a right-side view of the coated glove of FIG. 3, according to an exemplary embodiment.

Referring to FIGS. 3-5, a glove, such as work glove 100 is shown according to an exemplary embodiment. Work glove 100 may be formed using fixture 10. When self-supporting (i.e., without a user's hand or a fixture within the glove), work glove 100 is curved similar to a hand at rest.

Work glove 100 includes a body 102 and a coating layer 104 formed on body 102. Body 102 is hand-shaped and includes a palm portion 105, a back portion 106, a thumb portion 108, and a plurality of finger portions 110, specifically four finger portions 110 configured to receive a user's index, middle, ring, and little fingers.

Body 102 may be made from a flexible material, such as a knitted material, and coating layer 104 may be made from a material that provides additional durability and/or protection, such as a polymer material (e.g., nitrile). Coating material may be nitrile, polyurethane (solvent and aqueous), natural rubber, neoprene, polyvinyl chloride (PVC), silicone, butyl rubber, and mixes thereof where compatible.

Coating layer 104 is applied to body 102 through a dipping and curing process, where a work glove is dipped into a coating material and then cured in order to solidify the coating material into a coating layer. In various embodiments, coating layer 104 is processed to include a foaming finish or a sandy finish (i.e., industrial salt is used to affect the finish).

As shown, coating layer 104 is a single, contiguous, and continuous layer located along palm portion 105, thumb portion 108, palm-side/bottom side of finger portions 110, left and right sides of finger portions 110, and around tips of finger portions 110. Coating layer 104 is not located on back portion 106 opposite palm portion 105. As shown, at least part of the back side/top side of finger portions 110 does not include coating layer 104.

Coating layer 104 has a thickness that may vary by glove-type or application. The thickness may be uniform along body 102 or may have a greater thickness applied to some portions of body 102 (e.g., palm portion 105, palm-side of finger portions 110, or palm-side of thumb portion 108). In specific embodiments, thickness of coating layer 104 is between 0.025 mm and 1.0 mm. In a specific embodiment, the thickness is of coating layer 104 in palm portion 105 is less than the thickness in the finger portion 110 and/or thumb portion 108. In another specific embodiment, the thickness of coating layer 104 in palm portion 105 is 0.25 mm to 0.35 mm, and the thickness of the coating layer in the finger region is 0.45 mm to 0.55 mm. In specific embodiments, such thicknesses are defined as an average thickness of the entire coating layer 104, and in other embodiments, such thicknesses are defined as a maximum thickness anywhere within the coating layer 104.

When forming a work glove where the thickness is of coating layer 104 in palm portion 105 is less than the thickness in the finger portion 110 and/or thumb portion 108, a fixture, such as fixture 10, is oriented such that finger portions 110 of glove 100 are angled downwards (i.e., positioned below palm portion 105) such that excess coating material travels along glove 100 from palm portion 105 to finger portions 110, which leads to a greater accumulation of coating material on finger portions 110 during curing.

As shown, work glove 100 has two fingers portions which were formed when positioned in a first position (i.e., flattened position). Work glove 100 also includes three finger portions that are formed in a second position (i.e., curved towards palm portion 105). This second position can be achieved through using fixture 10 in the curing position. Applicant believes that the second position provides a coated glove 100 with improved fit and stretch and/improved coating thickness.

Figure 6:
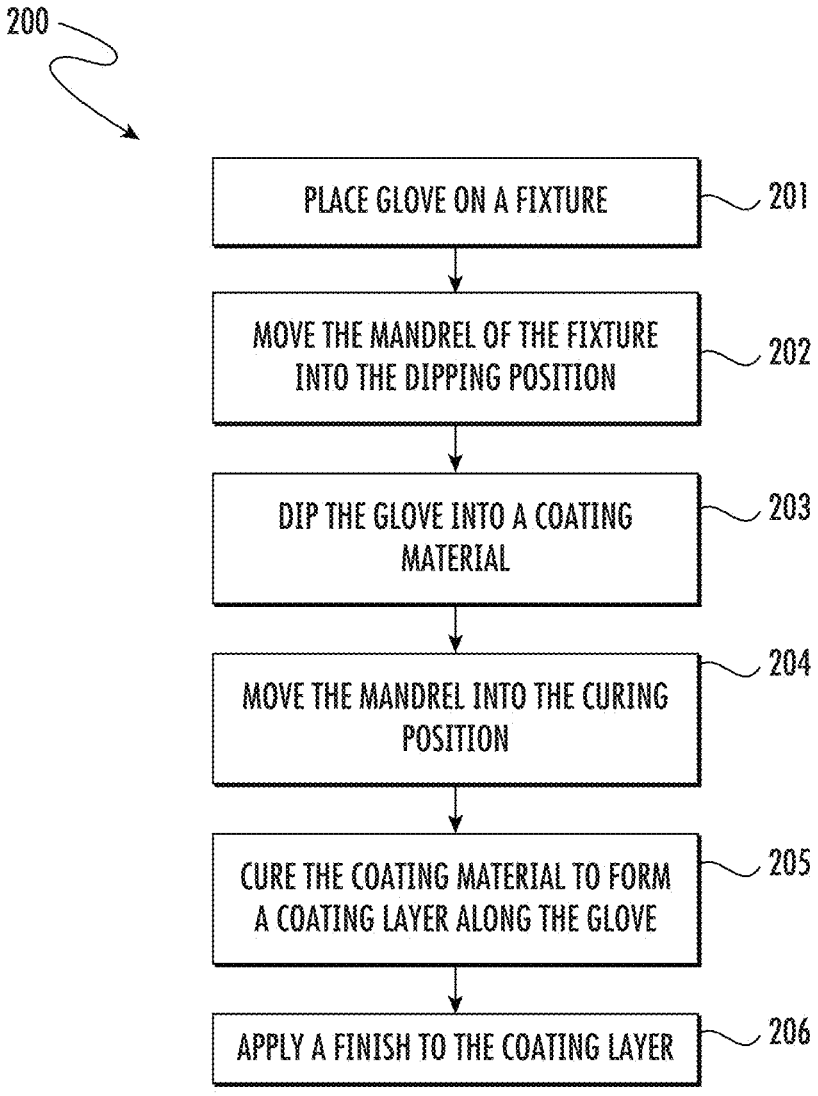
FIG. 6 is a flow diagram of a method of manufacturing a coated glove using an actuating fixture, such as the fixture of FIG. 1, according to an exemplary embodiment.

Referring to FIG. 6, a flow diagram of a method 200 for producing a coated glove, such as work glove 100, using a fixture, such as fixture 10 is provided. In step 201 of the method, a glove is placed on a fixture 10. In step 202, mandrel 12 is moved into the first position, or dipping position, as shown in FIG. 1. In step 203, at least a portion of the glove is dipped into a liquid material or coating material (e.g., a liquid polymer forming material). In step 204, the glove is then removed from the coating material, while the glove is still positioned on the fixture, the fixture moved into a second position or curing position, as shown in FIG. 2. In step 205, the coating material is cured to form a coating layer, such as coating layer 104, along an outer surface of the glove. In step 206, a finish is applied to the coating layer. That is, a foaming finish or a sandy finish (i.e., industrial salt is used to affect the finish) is applied to the coating layer after curing.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the disclosure will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present disclosure.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element and is not intended to be construed as meaning only one.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature. As used herein, "rigidly coupled" refers to two components being coupled in a manner such that the components move together in a fixed positional relationship when acted upon by a force.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A fixture for forming a coated glove, the fixture configured to move between a first position and a second position, the fixture comprising:

a mandrel comprising:

a first end configured to be mounted on a machine during the forming of a coated glove;

a second end opposite the first end; and a body extending between the first end and the second end, the body comprising a top surface and a bottom surface opposite the top surface;

a plurality of finger supports, each finger support in the plurality of finger supports comprising:

a first surface facing away from the top surface of the body; and a first section pivotally coupled to the second end of the mandrel by a first joint;

wherein an edge of the first joint abuts an inner face of the second end of the mandrel when the fixture is in the first position, and wherein the edge of the first joint is spaced apart from the inner face of the second end when the fixture is in the second position; and a thumb support coupled to the body;

wherein, when the fixture is in the first position, a portion of the bottom surface of the body located adjacent to the second end of the mandrel and each first surface of the plurality of finger supports are coplanar; and wherein, when the fixture is moved from the first position to the second position, the plurality of finger supports pivots with respect to the mandrel in a direction towards the bottom surface of the body.

2. The fixture of claim 1, wherein the body is sloped such that the first end of the body lies on a first plane and the second end lies on a second plane, wherein the first plane is spaced from and located above the second plane.

3. The fixture of claim 1, wherein each finger support in the plurality of finger supports further comprises:

a second section pivotally coupled to the first section by a second joint.

4. The fixture of claim 1, wherein the thumb support is pivotally coupled to the body.

5. The fixture of claim 4, wherein, when the fixture is moved from the first position to the second position, the thumb support pivots with respect to the mandrel away from the top surface of the body.

6. The fixture of claim 5, wherein, when the fixture is in the second position, at least a portion of the thumb support extends below the bottom surface of the body.

7. The fixture of claim 1, wherein the thumb support comprises a second surface facing away from the top surface of the body, wherein when the fixture is in the first position, the second surface of the thumb support is coplanar with the portion of the bottom surface of the body located adjacent to the first end of the mandrel.

8. The fixture of claim 1, wherein each first section and respective first joint are made from a single, continuous, and contiguous piece of material.

9. A fixture for forming a coated glove, the fixture movable between a dipping position and a curing position, the fixture comprising:

a mandrel comprising:

a first end configured to be mounted on a machine during the forming of a coated glove; and a second end opposite the first end, the second end comprising an inner face facing away from the first end of the mandrel;

a thumb support coupled to the mandrel between the first end and the second end;

a first finger support coupled to the second end of the mandrel, the first finger support comprising a first section pivotally coupled to the second end by a first joint, wherein, when the fixture is in the curing position, an edge of the first joint is spaced away from the inner face of the second end; and a second finger support coupled to the second end of the mandrel and positioned adjacent to the first finger support; and a third finger support coupled to the second end of the mandrel and positioned adjacent to the second finger support;

wherein, when the fixture is in the dipping position, a bottom surface of the first finger support, a bottom surface of the second finger support, and a bottom surface of the third finger support, each extend along substantially the same plane; and wherein, when the fixture is in the curing position, the bottom surface of the first finger support, the bottom surface of the second finger support, and the bottom surface of the third finger support, each are curved in a direction towards the first end of the mandrel.

10. The fixture of claim 9, wherein the first finger support further comprises:

a second section pivotally coupled to the first section by a second joint.

11. The fixture of claim 10, wherein, when the fixture is in the dipping position, a first edge of the first joint abuts an inner face of the second end and a second edge of the second joint abuts an inner face of the first section such that that there is less distance between the first edge of the first joint and inner face of the second end when the fixture is in the dipping position than when it is in the curing position.

12. The fixture of claim 10, wherein when in the dipping position, an angle defined between the first section and the second section of the first finger support is at least 170 degrees.

13. The fixture of claim 10, wherein when in the curing position, an angle defined between the first section and the second section of the first finger support is at most 135 degrees.

14. The fixture of claim 11, wherein the second finger support comprises:

a third section pivotally coupled to the second end by a third joint; and a fourth section pivotally coupled to the third section by a fourth joint; and wherein, when in the curing position, a first angle defined between the first section and the second section of the first finger support is greater than a second angle defined between the third section and the fourth section of the second finger support.

15. The fixture of claim 10, wherein the second section and the second joint are made from a single, continuous, and contiguous piece of material such that the second section and the second joint move together with respect to the first section when the fixture moves between the dipping position and the curing position.

16. The fixture of claim 9, wherein the first section and the first joint are made from a single, continuous, and contiguous piece of material such that first section and the first joint move together with respect to the second end when the fixture moves between the dipping position and the curing position.

17. The fixture of claim 9, wherein the second end comprises a first projection and a second projection, and wherein the first joint is positioned between the first projection and the second projection.

18. The fixture of claim 9, wherein the first joint defines a hinged connection between the first section and the second end.

* * * * *